US007669649B2

(12) United States Patent
Williams

(10) Patent No.: US 7,669,649 B2
(45) Date of Patent: Mar. 2, 2010

(54) STRIPPER RUBBER WITH INTEGRAL RETRACTING RETENTION MEMBER CONNECTION APPARATUS

(76) Inventor: John R. Williams, Georgetown, TX (US); Theresa J. Williams, legal representative, 505 W. 21st St., Georgetown, TX (US) 78626

( * ) Notice: Subject to any disclaimer, the term of this patent is extended or adjusted under 35 U.S.C. 154(b) by 145 days.

(21) Appl. No.: 11/975,201

(22) Filed: Oct. 18, 2007

(65) Prior Publication Data

US 2009/0101333 A1 Apr. 23, 2009

(51) Int. Cl.
*E21B 19/00* (2006.01)

(52) U.S. Cl. ..... 166/84.3; 175/195; 175/214; 285/123.2

(58) Field of Classification Search ..... 166/85.1, 166/85.3, 85.5, 84.3; 175/195; 277/323, 277/324

See application file for complete search history.

(56) References Cited

U.S. PATENT DOCUMENTS 557,423 A 3/1896 Outhouse et al.
1,037,072 A 8/1912 Snyder
1,372,297 A 3/1921 Kennedy
3,796,448 A 3/1974 Ringkamp
4,345,769 A * 8/1982 Johnston ..... 277/343
4,606,557 A 8/1986 Coffey
4,743,079 A 5/1988 Bloch
5,279,365 A * 1/1994 Yenulis et al. ..... 166/84.3
5,348,107 A 9/1994 Bailey et al.
5,829,480 A 11/1998 Smith, III
6,230,824 B1 5/2001 Peterman et al.
7,159,652 B2 * 1/2007 McGuire et al. ..... 166/75.13
2005/0236835 A1 * 10/2005 Williams ..... 285/361
2007/0199690 A1 8/2007 Williams

* cited by examiner

*Primary Examiner*—David J Bagnell
*Assistant Examiner*—James G Sayre
(74) *Attorney, Agent, or Firm*—David O. Simmons

(57) ABSTRACT

A stripper rubber insert comprises a central bore and a plurality of retention member bores substantially perpendicular to the central bore. The retention member bores are angularly spaced apart around a perimeter of the stripper rubber insert. Each one of the retention member bores extends through an exterior insert edge face and an interior insert edge face. Each one of the retention member bores includes a respective retention member securing structure therein.

19 Claims, 3 Drawing Sheets

STRIPPER RUBBER WITH INTEGRAL RETRACTING RETENTION MEMBER CONNECTION APPARATUS

FIELD OF THE DISCLOSURE

The present disclosure relates to connectors and connector systems for making mechanical connections. More particularly, the disclosure provides apparatus, systems and methods for facilitating a stripper rubber being connected to and disconnected from equipment, such as for example a bearing assembly, of a drilling head to pressure-seal the interior of a well bore for the circulation, containment or diversion of drilling materials through the well during drilling operations.

BACKGROUND

Oil, gas, water and geothermal wells are typically drilled with a drill bit connected to a hollow drill string which is inserted into a well casing cemented in the well bore. A drilling head is attached to the well casing, wellhead or to associated blowout preventer equipment, for the purposes of sealing the interior of the well bore from the surface and facilitating forced circulation of drilling fluid through the well while drilling or diverting drilling fluids away from the well. Drilling fluids include, but are not limited to, water, steam, drilling muds, air, and other gases.

In the forward circulation drilling technique, drilling fluid is pumped downwardly through the bore of the hollow drill string, out the bottom of the hollow drill string and then upwardly through the annulus defined by the drill string and the interior of the well casing, or well bore, and subsequently out through a side outlet above the well head. In reverse circulation, a pump impels drilling fluid through a port, down the annulus between the drill string and the well casing, or well bore, and then upwardly through the bore of the hollow drill string and out of the well.

Drilling heads typically include a stationary body, often referred to as a bowl, which carries a rotatable spindle such as a bearing assembly, rotated by a kelly apparatus or top drive unit. One or more seals or packing elements, often referred to as stripper packers or stripper rubbers, is carried by the spindle to seal the periphery of the kelly or the drive tube or sections of the drill pipe, whichever may be passing through the spindle and the stripper rubber, and thus confine or divert the core pressure in the well to prevent the drilling fluid from escaping between the rotating spindle and the drilling string.

As modern wells are drilled ever deeper, or into certain geological formations, very high temperatures and pressures may be encountered at the drilling head. These rigorous drilling conditions pose increased risks to rig personnel from accidental scalding, burns or contamination by steam, hot water and hot, caustic well fluids. There is a danger of serious injury to rig workers when heavy tools are used to make a stripper rubber connection at the drilling head. The connection should be made quickly and achieve a fluid tight seal.

Rotating blowout preventers and diverters are well known to those of ordinary skill in the art of well pressure control. Rotation of the diverter/preventer is facilitated by a sealing engaged bearing assembly through which the drill string rotates relative to the stationary bowl or housing in which the bearing assembly is seated. Typically, a rubber O-ring seal, or similar seal, is disposed between the stripper rubber and the bearing assembly to improve the fluid-tight connection between the stripper rubber and the bearing assembly.

Pressure control is achieved by means of one or more stripper rubbers connected to the bearing assembly and disposed around the drill string. At least one stripper rubber rotates with the drill string. Stripper rubbers typically taper downward and include rubber or other resilient substrate so that the downhole pressure pushes up on the rubber, pressing the rubber against the drill string to achieve a fluid-tight seal. Stripper rubbers often further include a metal insert that provide support for bolts or other attachment means and which also provide a support structure to minimize deformation of the rubber cause by down hole pressure forces acting on the rubber.

Stripper rubbers are connected or adapted to equipment of the drilling head to establish and maintain the pressure control seal around a down hole tubular (i.e., a drill string). It will be understood by those skilled in the art that a variety of means are used to attach a stripper rubber to associated drilling head equipment. Such attachment means include bolting from the top, bolting from the bottom, screwing the stripper rubber directly onto the equipment via cooperating threaded portions on the top of the stripper rubber and the bottom of the equipment, and clamps.

It will be understood that, depending on the particular equipment being used at a drilling head, a stripper rubber at one well may be connected to equipment specific to that well while at another well a stripper rubber is connected to different equipment. For example, at one well the stripper rubber may be connected to the bearing assembly while at another well the stripper rubber may be connected to an inner barrel or an accessory of the drilling head. While the present disclosure is made here in relation to connecting the stripper rubber to the bearing assembly, it will be evident that the disclosure contemplates connection of the stripper rubber to any selected equipment of the drilling head.

It is common practice to tighten the bolts or screws of the connection with heavy wrenches and sledge hammers. The practice of using heavy tools to tighten a bolt, for example, can result in over-tightening, to the point where the threads or the bolt head become stripped. The results of over-tightening include stripped heads, where the bolt or screw cannot be removed, or stripped threads, where the bolt or screw has no grip and the connection fails. Both results are undesirable.

Even worse, vibration and other drilling stresses can cause bolts or screws to work themselves loose and fall out. If one or more falls downhole, the result can be catastrophic. The drill bit can be ruined. The entire drillstring may have to tripped out, and substantial portions replaced, including the drill bit. If the well bore has been cased, the casing may be damaged and have to be repaired.

Drilling head assemblies periodically need to be disassembled to replace stripper rubbers or other parts, lubricate moving elements and perform other recommended maintenance. In some circumstances, stripped or over tightened bolts or screws make it very difficult if not impossible to disengage the stripper rubber from the drilling head assembly to perform recommended maintenance or parts replacement.

It is desirable, therefore, to obtain a connector for optionally connecting a stripper rubber assembly to a bearing assembly, or other equipment, of a drilling head that is effective, safe, simple, fast and elegant.

SUMMARY OF THE DISCLOSURE

In view of the foregoing, the present invention, through one or more of its various aspects, embodiments and/or specific features or sub-components, is thus intended to bring out one or more of the advantages that will be evident from the disclosures made herein. More specifically, the present invention facilitates connection of a stripper rubber to drilling head equipment. Embodiments of the present invention provide a fast, simple and reliable means for detachably attaching the stripper rubber to drilling head equipment and, optionally, facilitating transmission of rotary torque loads applied on the stripper rubber from the rotating drill string and exerted from the stripper rubber onto a corresponding rotating component of the drilling head equipment (e.g., an inner barrel of the rotating control head).

In one embodiment of the present invention, a system is provided for allowing a stripper rubber to be disconnectably connected to a stripper rubber to drilling head equipment. The system comprises a stripper rubber, a bearing assembly inner barrel and a plurality of retention members. The stripper rubber includes a stripper rubber insert having a central bore and a plurality of retention member bores substantially perpendicular to the central bore. The retention member bores are angularly spaced apart around a perimeter of the stripper rubber insert. Each one of the retention member bores extends through an exterior insert edge face and an interior insert edge face. Each one of the retention member bores includes a respective retention member securing structure therein. The bearing assembly inner barrel has a first end portion thereof configured for being received within the central bore of the stripper rubber insert. The bearing assembly inner barrel includes a plurality of retention member engaging structures accessible through an exterior barrel face adjacent the first end portion thereof. The retention member engaging structures are spaced apart around a perimeter of the stripper rubber insert in a manner allowing each one of the retention member engaging structures to be aligned with a respective one of the retention member bores. Each one of the retention members is retractably engagable with the retention member securing structure of a respective one of the retention member bores. Being retractably engaged includes each one of the retention members being selectively translatable along a longitudinal axis of the respective one of the retention member bores thereby allowing each one of the retention members to be selectively engaged with and disengaged from the respective one of the retention member engaging structures.

In another embodiment of the present invention, a stripper rubber insert comprises a central bore and a plurality of retention member bores substantially perpendicular to the central bore. The retention member bores are angularly spaced apart around a perimeter of the stripper rubber insert. Each one of the retention member bores extends through an exterior insert edge face and an interior insert edge face. Each one of the retention member bores includes a respective retention member securing structure therein.

In another embodiment of the present invention, an apparatus includes a stripper rubber disconnectably connected to a stripper rubber to drilling head equipment. The apparatus comprises a stripper rubber, a bearing assembly inner barrel and a plurality of retention members. The stripper rubber includes a stripper rubber insert having a central bore and a plurality of retention member bores substantially perpendicular to the central bore. The retention member bores are angularly spaced apart around a perimeter of the stripper rubber insert. Each one of the retention member bores extends through an exterior insert edge face and an interior insert edge face. Each one of the retention member bores includes a respective retention member securing structure therein. The bearing assembly inner barrel has a first end portion thereof disposed within the central bore of the stripper rubber insert. The bearing assembly inner barrel includes a plurality of retention member engaging structures accessible through an exterior barrel face adjacent the first end portion thereof. Each one of the retention member engaging structures is aligned with a respective one of the retention member bores. Each one of the retention members is retractably engaged with the retention member securing structure of a respective one of the retention member bores. Each one of the retention members is engaged with a respective one of the retention member engaging structures for precluding relative rotation and axial displacement of the stripper rubber insert with respect to the bearing assembly inner barrel. Being retractably engaged includes each one of the retention members being selectively translatable along a longitudinal axis of the respective one of the retention member bores thereby allowing each one of the retention members to be selectively engaged with and disengaged from the respective one of the retention member engaging structures.

These and other objects, embodiments, advantages and/or distinctions of the present invention will become readily apparent upon further review of the following specification, associated drawings and appended claims.

BRIEF DESCRIPTION OF THE DRAWINGS

The present disclosure is further made in the detailed description that follows, by reference to the noted drawings, by way of non-limiting examples of embodiments in which like reference numerals represent similar parts throughout several views of the drawings, and in which.

DETAILED DESCRIPTION

Figure 1:
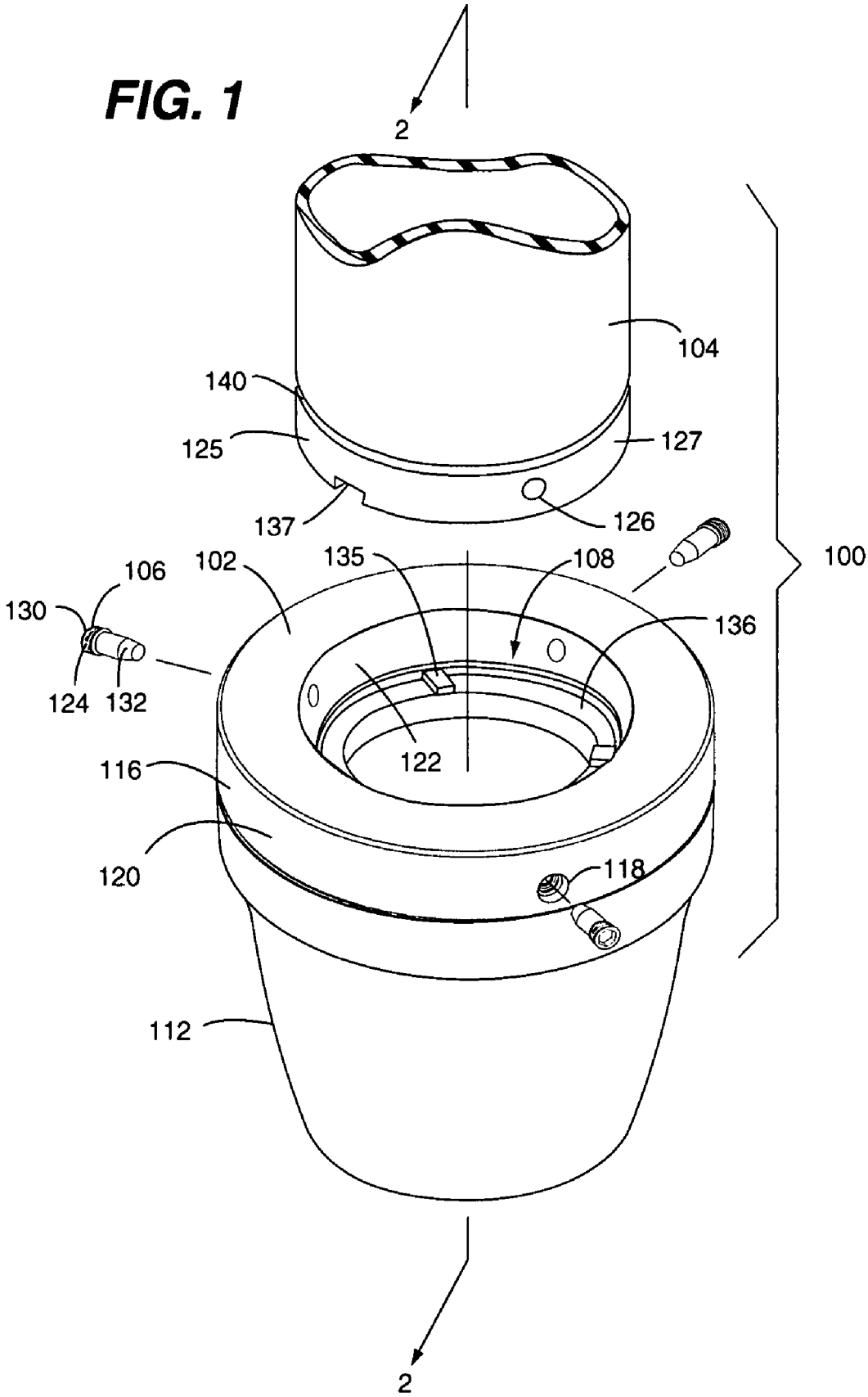
FIG. 1 shows a stripper rubber-inner barrel system in accordance with an embodiment of the present invention.
Figure 2:
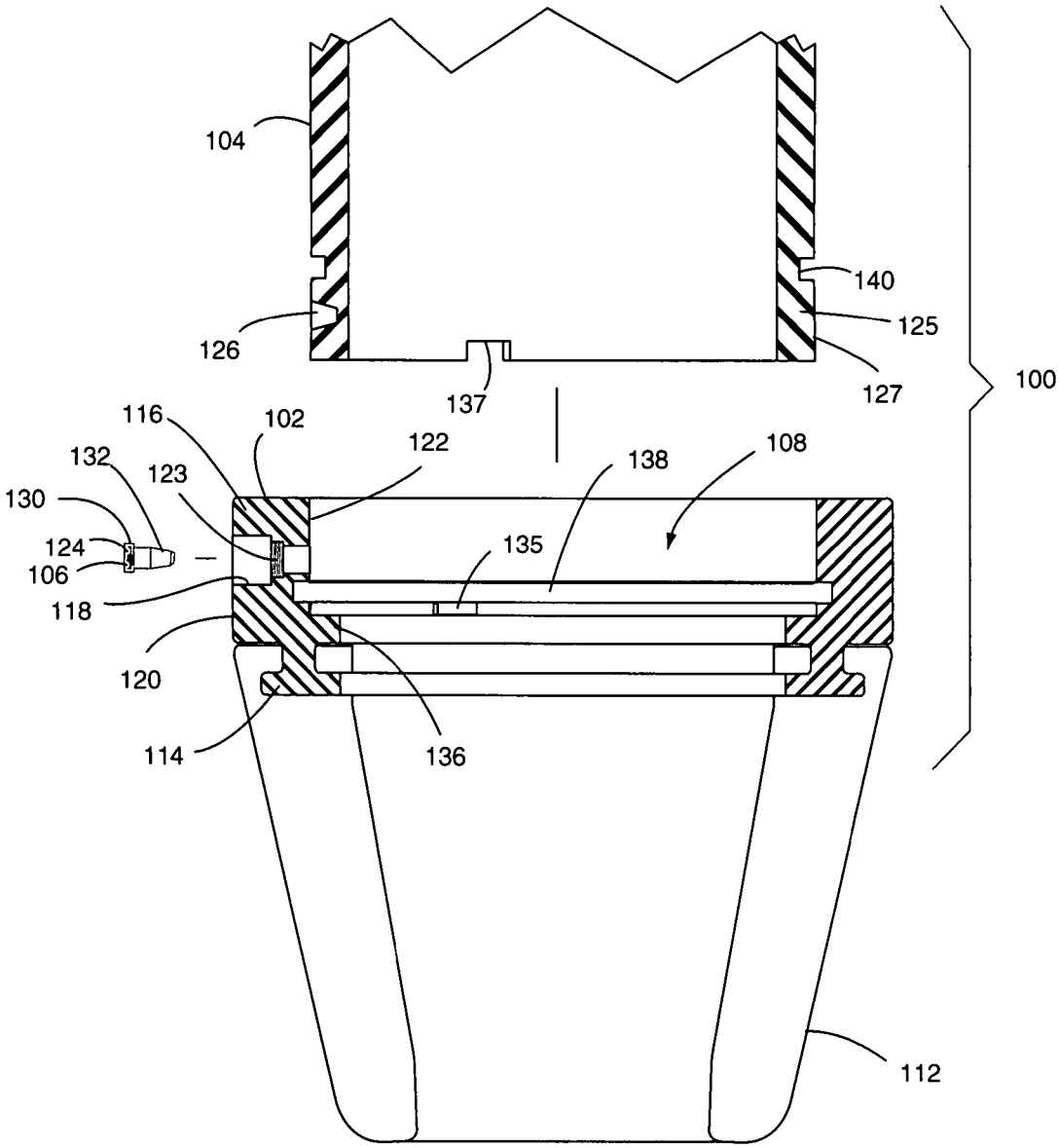
FIG. 2 is a cross-sectional view taken along the line 2-2 in FIG. 1, wherein the bearing assembly inner barrel being in a detached orientation with respect to the stripper rubber insert.
Figure 3:
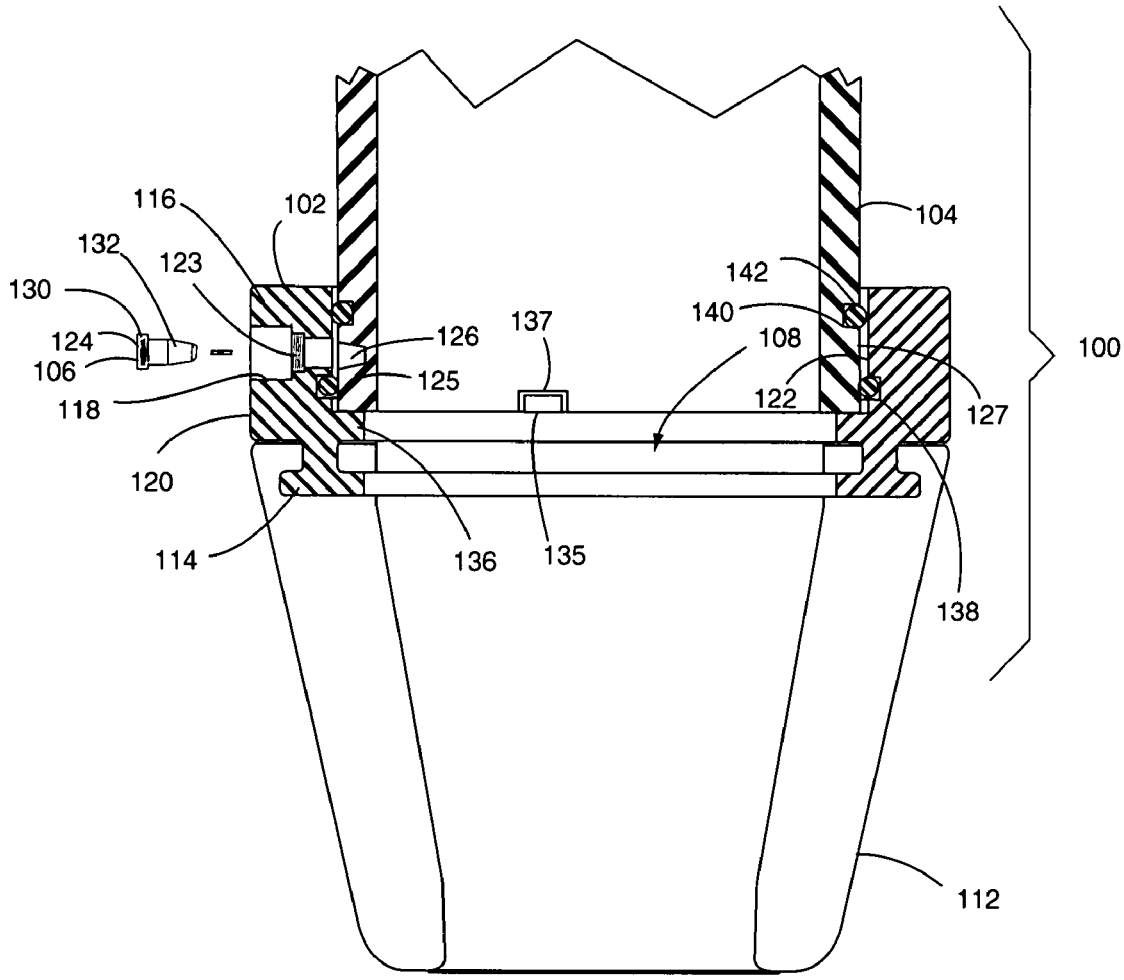
FIG. 3 is a cross-sectional showing substantially the same as FIG. 2, wherein the bearing assembly inner barrel being in a mounted orientation with respect to the stripper rubber insert.

Referring to FIGS. 1-3, an embodiment of a system 100 for disconnectably connecting a stripper rubber to drilling head equipment in accordance with the present invention is shown. The system 100 includes a stripper rubber insert 102, a bearing assembly inner barrel 104 and a plurality of retention members 106. As is discussed below in greater detail, the stripper rubber insert 102, the bearing assembly inner barrel 104 and the retention members 106 are jointly configured for being interconnected in a manner that is advantageous, novel and non-obvious. Aspects of the present invention that contribute to such advantageous, novel and non-obvious interconnection include, but are not limited to, such interconnection providing a fast, simple and reliable means for detachably attaching the stripper rubber insert 102 to the bearing assembly inner barrel 104 in a manner that facilitates transmission of rotary torque loads applied on the stripper rubber 102 from a rotating drill string (not shown) that extends through a central bore 108 of the stripper rubber insert 102.

In use, the stripper rubber insert 102 has a stripper rubber body 112 attached thereto. The combination of the stripper rubber insert 102 and the stripper rubber body 112 are commonly referred to as a stripper rubber or stripper rubber assembly. In a typical stripper rubber, the stripper rubber insert 102 is made from steel and the stripper rubber body 112 is made from an elastomeric material (e.g., synthetic rubber).

As best shown in FIGS. 2 and 3, the stripper rubber insert 102 includes a mechanical bonding portion 114 and a barrel engaging portion 116. The stripper rubber body 112 is formed over the mechanical bonding portion 114 and can optionally be formed over the at least a portion of the barrel engaging portion 116. Preferably, the mechanical bonding portion 114 includes one or more features that enhance the mechanical interface between the stripper rubber body material and the stripper rubber insert 102. Examples of the mechanical interface enhancing features include undercuts, windows, passages and the like. In addition to mechanical interface enhancing features, it is also known to coat all or a portion of a stripper rubber insert with a bonding agent that enhances adhesion between the stripper rubber body material and the stripper rubber insert.

The stripper rubber insert 102 includes a plurality of retention member bores 118. The retention member bores 118 extend substantially perpendicular to the central bore 108. Each one of the retention member bores 118 extends through an exterior inner edge face 120 and an interior insert edge face 122 of the stripper rubber insert 102. As best shown in FIGS. 2 and 3, each one of the retention member bores 118 includes a threaded portion 123, which is configured for being threadedly engaged with a mating threaded portion 124 of a respective retention member 106. In this manner, each one of the retention members 106 is retractably engagable with the threaded portion (i.e., retention member securing structure) of the respective one of the retention member bores 118.

Still referring to FIGS. 1-3, the bearing assembly inner barrel 104 has a first end portion 125 configured for being disposed within the central bore 108. The bearing assembly inner barrel 104 includes a plurality of retention member engaging structures 126 (one shown in each drawing figure) accessible through an exterior barrel face 127 adjacent the first end portion 125. The retention member engaging structures 126 are angularly spaced around a perimeter of the exterior barrel face 127 in a manner allowing each one of the retention member engaging structures 126 to be aligned with a respective one of the retention member bores 118 when the first end portion 125 of the bearing assembly inner barrel 104 is disposed within the central bore 108 (i.e., as shown in FIG. 3).

Each one of the retention members 106 is engaged with a respective one of the retention member engaging structures 126 for precluding relative rotation and axial displacement of the stripper rubber insert with respect to the bearing assembly inner barrel 104. Being retractably engaged includes each one of the retention members 106 being selectively translatable along a longitudinal axis of the respective one of the retention member bores 118 thereby allowing each one of the retention members 106 to be selectively engaged with and disengaged from the respective one of the retention member engaging structures 118. As shown, the threaded interface between a retention member 106 and the threaded portion 123 of the respective retention member bores 118 is facilitated by rotation of the retention members 106.

As shown in FIGS. 1-3, each one of the retention members 106 includes a head portion 130 and a tip portion 132. The head portion 130 carries the threaded portion 124 that matingly engages the threaded portion 123 of the respective retention member bores 118. Through such threaded portions (123, 124), the retention members 106 are retractably engagable within the respective one of the retention member bores 118, thereby allowing each retention member 106 to be selectively translated along a longitudinal axis of an engaged one of the retention member bores 118 in an engagement direction (i.e., a first direction that is toward the bearing assembly inner barrel 104) and a disengagement direction (i.e., a second direction that is away from the bearing assembly inner barrel 104).

When the first end portion 125 of the bearing assembly inner barrel 104 is suitably disposed within the central bore 108 of the stripper rubber insert 102 and each one of the retention member bores 118 is aligned with a respective one of the retention member engaging structures 126, the tip portion 132 of each retention member 106 lockingly engages a respective one of the retention member engaging structures 126 through sufficient displacement of each retention member 106 in the engagement direction from a disengaged position (i.e., a position thereby allowing insertion of the bearing assembly inner barrel 104 into the central bore 108 of the stripper rubber insert 102). In this manner, the retention members 106 and retention member engaging structures 126 are jointly configured for selectively precluding withdrawal of the bearing assembly inner barrel 104 from within the central bore 108 of the stripper rubber insert 102. Thereafter, the stripper rubber insert 102 can be detached from the bearing assembly inner barrel 104 upon sufficient displacement of the retention members 106 in the disengagement direction. In this manner, the retention members 106 and the retention member engaging structures 126 are jointly configured for selectively allowing withdrawal of the bearing assembly inner barrel 104 from within the central bore 108 of the stripper rubber insert 102.

As best shown in FIGS. 2 and 3, each one of the retention member engaging structures 126 is a cavity having a generally round cross section and a tapered profile along the depth. In another embodiment, the tapered profile is omitted. In yet another embodiment, each retention member engaging structures is an aperture that extends through the through a thickness of the bearing assembly inner barrel 104. In still another embodiment, the cross section is that of a slot as opposed to being generally round.

The stripper rubber insert 102 includes a shoulder 136 within the central bore 108. The shoulder 136 is configured for engaging the bearing assembly inner barrel 104 to limit an insertion depth of the bearing assembly inner barrel 104 within the central bore. To this end, as shown in FIG. 3, the first end portion 125 of the bearing assembly inner barrel 104 abuts the shoulder 136.

To facilitating angular indexing and anti-rotation functionality, the stripper rubber insert 102 includes a plurality of interlock features 135 that each engage a mating interlock feature 137 of the bearing assembly inner barrel 104. As shown, each interlock features 135 of the stripper rubber insert 102 is a raised protrusion and each interlock feature 137 of the bearing assembly inner barrel 104 is a recessed portion. Alternatively, each interlock feature 135 of the stripper rubber insert 102 can be a recessed portion and each interlock feature 137 of the bearing assembly inner barrel 104 can be a raised protrusion.

The interlock features 135, 137 are jointly configured for substantially limiting relative rotation between the stripper rubber insert and the bearing assembly inner barrel about an axis of rotation of the bearing assembly inner barrel in both clockwise and counterclockwise directions when the interlock features are engaged.

To preclude flow paths between the stripper rubber insert 102 and the bearing assembly inner barrel 104, one or more seal interfaces are provided between the stripper rubber insert 102 and the bearing assembly inner barrel 104. In one embodiment, as shown in FIGS. 2 and 3, a first seal receiving groove 138 is provided in the interior insert edge face 122 of the stripper rubber insert 102 and a second seal receiving groove 140 is provided in the exterior barrel face 127 of the bearing assembly inner barrel 104. The first seal receiving groove is preferably positioned between the shoulder 136 and the retention member bores 118. As shown in FIG. 3, insertion of a sealing device 142 (e.g., an O-ring seal) into each one of the seal receiving grooves (138, 140) provides for two seal interfaces between the stripper rubber insert 102 and the bearing assembly inner barrel 104. Alternatively, both seal receiving grooves (138, 140) can be carried by the bearing assembly inner barrel 104 or both seal receiving grooves (138, 140) can be carried by the stripper rubber insert 102.

As shown in FIGS. 1-3, the retention member engaging structures 126 and the tip portion 132 of each retention member 106 are tapered. Thus, engagement of the retention members 106 with the engagement pins 118 result in biasing of the stripper rubber insert 102 toward the bearing assembly inner barrel 104. However, it is disclosed herein that the retention member engaging structures 126 and the tip portion 132 of each retention member 106 can be made in a manner (e.g., non-tapered) whereby engagement of the retention members 106 with the engagement pins 118 does not result in a significant amount of biasing of the stripper rubber insert 102 toward the bearing assembly inner barrel 104.

As shown in FIGS, 1-3, selective translation of the retention members 106 is provided for via the head portion 130 of each retention member 106 having threads that matingly engage threads of the respective retention member bore 118. Thus, rotation of each retention member 106 in a first rotational direction causes translation in the engagement direction and rotation of each retention member 106 in a second rotational direction causes translation in the disengagement direction. Such threaded engagement is one example of facilitating selective translation of the retention members 106 within the retention member bores 118.

It is disclosed herein that the present invention is not limited to a particular arrangement for allowing selective translation of the retention members 106 within the retention member bores 118. A skilled person will appreciate that other arrangements for allowing selective translation of retention members within retention member bores can be used in place of the threaded arrangement. One example of such other arrangements is a twist-lock arrangement where a retention member is slid to a depth in the respective retention member bore where it is engaged with respective engagement pins, and is then locked in place by being twisted a fraction of a complete rotation. In such an arrangement, it can be useful to implement some form of anti-rotation mechanism to prevent unintentional rotation of the retention member. Another example of such other arrangements is where a retention member is slideably and captive disposed within a respective retention member bore, being spring biased in the engagement direction such to it is manually displaced to in the disengaged position for along the an engagement pin to be fully inserted within a respective engagement pin bore.

It is good practice to periodically replace or maintain stripper rubbers because stripper rubbers tend to wear out. To replace a stripper rubber, the stripper rubber must be disconnected from the drilling head equipment. To disconnect a stripper rubber pursuant to the present invention, it is a simple matter of rotating each retention member such that each retention member retracts a required distance to disengage from the respective retention member engaging structure. A new stripper rubber can then be installed by manipulating the stripper rubber such that the central bore of the stripper rubber insert has an end portion of the bearing assembly inner barrel disposed therein, followed by engaging the retention members to a sufficient depth in the retention member bores such that each retention member engages a respective retention member engaging structure.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. An apparatus, comprising:

a stripper rubber including a stripper rubber insert having a central bore and a plurality of retention member bores substantially perpendicular to the central bore, wherein said retention member bores are angularly spaced apart around a perimeter of the stripper rubber insert, wherein each one of said retention member bores extends through an exterior insert edge face and an interior insert edge face, wherein each one of said retention member bores includes a respective retention member securing structure therein, wherein the stripper rubber insert includes a shoulder within the central bore configured for engaging a bearing assembly inner barrel to limit an insertion depth of the bearing assembly inner barrel within the central bore, and wherein the stripper rubber insert includes an interlock feature;

a bearing assembly inner barrel having a first end portion thereof disposed within the central bore of said stripper rubber insert, wherein the bearing assembly inner barrel includes a plurality of retention member engaging structures accessible through an exterior barrel face adjacent the first end portion thereof, wherein each one of said retention member engaging structures is aligned with a respective one of said retention member bores, and wherein the bearing assembly inner barrel includes an interlock feature configured for being engaged by the interlock feature of the stripper rubber insert; and a plurality of retention members each retractably engaged with the retention member securing structure of a respective one of said retention member bores, wherein each one of said retention members is engaged with a respective one of said retention member engaging structures for precluding relative rotation and axial displacement of the stripper rubber insert with respect to the bearing assembly inner barrel and wherein being retractably engaged includes each one of said retention members being selectively translatable along a longitudinal axis of the respective one of said retention member bores thereby allowing each one of said retention members to be selectively engaged with and disengaged from the respective one of said retention member engaging structures;

wherein said interlock features are jointly configured for limiting relative rotation between the stripper rubber insert and the bearing assembly inner barrel without inhibiting separation of the stripper rubber insert from the bearing assembly when said interlock features are engaged with each other wherein said interlock features are jointly configured for substantially limiting relative rotation between the stripper rubber insert and the bearing assembly inner barrel about an axis of rotation of the bearing assembly inner barrel in both clockwise and counterclockwise directions when said interlock features are engaged;

wherein the bearing assembly inner barrel, the stripper rubber insert and said retention members are jointly configured such that separation of the stripper rubber insert from the bearing assembly inner barrel requires no relative rotation of the stripper rubber with respect to the bearing assembly inner barrel;

wherein said retention members exclusively inhibit longitudinal displacement of the stripper rubber insert relative to the bearing assembly inner barrel in a direction corresponding to separation of said separation of the stripper rubber insert from the bearing assembly inner barrel.

2. The apparatus of claim 1, further comprising:

a seal disposed within a seal receiving structure of at least one of the stripper rubber insert and the bearing assembly inner bore, wherein the seal provides a sealed interface between the stripper rubber insert and the bearing assembly inner barrel.

3. The apparatus of claim 2 wherein:

the seal receiving structure includes a seal receiving groove carried by the stripper rubber insert and extending around the interior insert edge face.

4. The apparatus of claim 3 wherein the seal receiving groove is positioned between the shoulder and said retention member bores.

5. The apparatus of claim 1, further comprising:

a seal disposed within a seal receiving structure of the stripper rubber insert and a seal disposed within a seal receiving structure of the bearing assembly inner barrel, wherein said seals each provide a sealed interface between the stripper rubber insert and the bearing assembly inner barrel, the seal receiving structure of the stripper rubber insert is within the interior insert edge face, the seal receiving structure of the stripper rubber insert is positioned between the shoulder and said retention member bores, the seal receiving structure of the bearing assembly inner barrel is within the exterior barrel side face, and said retention member engaging structures of the bearing assembly inner barrel are positioned between the seal receiving groove thereof and an end face thereof that engages the shoulder.

6. A system for allowing a stripper rubber to be disconnectably connected to drilling head equipment, the system comprising:

a stripper rubber insert including a central bore and a plurality of retention member bores substantially perpendicular to the central bore, wherein said retention member bores are angularly spaced apart around a perimeter of the stripper rubber insert, wherein each one of said retention member bores extends through an exterior insert edge face and an interior insert edge face, wherein each one of said retention member bores includes a respective retention member securing structure therein, wherein the stripper rubber insert includes a shoulder within the central bore configured for engaging a bearing assembly inner barrel to limit an insertion depth of the bearing assembly inner barrel within the central bore, and wherein the stripper rubber insert includes an interlock feature;

a bearing assembly inner barrel having a first end portion thereof configured for being received within the central bore of said stripper rubber insert, wherein the bearing assembly inner barrel includes a plurality of retention member engaging structures accessible through an exterior barrel side face adjacent the first end portion thereof and wherein said retention member engaging structures are spaced apart around a perimeter of the bearing assembly inner barrel in a manner allowing each one of said retention member engaging structures to be aligned with a respective one of said retention member bores, and wherein the bearing assembly inner barrel includes an interlock feature configured for being engaged by the interlock feature of the stripper rubber insert; and a plurality of retention members, wherein each one of said retention members is retractably engagable with the retention member securing structure of a respective one of said retention member bores, wherein being retractably engaged includes each one of said retention members being selectively translatable along a longitudinal axis of the respective one of said retention member bores thereby allowing each one of said retention members to be selectively engaged with and disengaged from the respective one of said retention member engaging structures;

wherein said interlock features are jointly configured for limiting relative rotation between the stripper rubber insert and the bearing assembly inner barrel without inhibiting separation of the stripper rubber insert from the bearing assembly when said interlock features are engaged with each other wherein said interlock features are jointly configured for substantially limit relative rotation between the stripper rubber insert and the bearing assembly inner barrel about an axis of rotation of the bearing assembly inner barrel in both clockwise and counterclockwise directions when said interlock features are engaged;

wherein the bearing assembly inner barrel, the stripper rubber insert and said retention members are jointly configured such that separation of the stripper rubber insert from the bearing assembly inner barrel requires no relative rotation of the stripper rubber with respect to the bearing assembly inner barrel;

wherein said retention members exclusively inhibit longitudinal displacement of the stripper rubber insert relative to the bearing assembly inner barrel in a direction corresponding to separation of said separation of the stripper rubber insert from the bearing assembly inner barrel.

7. The system of claim 6 wherein:

the stripper rubber insert further includes a seal receiving structure within the interior insert edge face;

the seal receiving structure of the stripper rubber insert is positioned between the shoulder and said retention member bores;

the bearing assembly inner barrel includes a seal receiving structure within the exterior barrel side face; and said retention member engaging structures of the bearing assembly inner barrel are positioned between the seal receiving structure thereof and an end face thereof that engages the shoulder.

8. The system of claim 7 wherein the seal receiving structure is positioned between the shoulder and said retention member bores.

9. The system of claim 8 wherein the seal receiving structure is a seal receiving groove extending around the interior insert edge face.

10. The system of claim 6 wherein the stripper rubber insert and the bearing assembly inner barrel each include means for carrying a sealing device for providing a sealed interface therebetween.

11. The system of claim 10 wherein:

said means for carrying the sealing device is a seal receiving groove;

the seal receiving groove of the stripper rubber insert is within the interior insert edge face;

the seal receiving groove of the stripper rubber insert is positioned between the shoulder and said retention member bores;

the seal receiving groove of the bearing assembly inner barrel is within the exterior barrel side face; and said retention member engaging structures of the bearing assembly inner barrel are positioned between the seal receiving groove thereof and an end face thereof that engages the shoulder.

12. The system of claim 11 wherein:

the retention member securing structure of each one of said retention member bores includes threads; and each one of said retention members includes a threaded portion configured for engaging said threads of a respective one of said retention member bores.

13. The system of claim 12 wherein:

opposing sided faces of said interlock features extend substantially parallel with thee axis if rotation of the bearing assembly inner barrel.

14. A stripper rubber insert, comprising:

a central bore;

a plurality of retention member bores substantially perpendicular to the central bore;

a shoulder within the central bore configured for engaging a bearing assembly inner barrel to limit an insertion depth of the bearing assembly inner barrel within the central bore; and an interlock feature integral with the shoulder and configured for engaging a mating interlock feature of the bearing assembly inner barrel for limiting relative rotation between the stripper rubber insert and the bearing assembly inner barrel without inhibiting separation of the stripper rubber insert from the bearing assembly, wherein the interlock feature of the stripper rubber insert extended one of into the shoulder and from the shoulder, wherein the interlock feature of the stripper rubber insert is configured for substantially limit relative rotation between the stripper rubber insert and the bearing assembly inner barrel about an axis of rotation of the bearing assembly inner barrel in both clockwise and counterclockwise directions when engaged with the mating interlock feature of the bearing assembly inner barrel;

wherein said retention member bores are angularly spaced apart around a perimeter of the stripper rubber insert;

wherein the interlock feature is configured for engaging a mating interlock feature of the of the bearing assembly inner barrel for limiting only relative rotation between the stripper rubber insert and the bearing assembly inner barrel;

wherein each one of said retention member bores extends through an exterior insert edge face and an interior insert edge face;

wherein each one of said retention member bores includes a respective retention member securing structure therein; and wherein the respective retention member securing structure of each one of said retention member bores is configured such that rotation in a first rotational direction of a retention member engaged therewith causes translation of the retention member in a direction toward the central bore and such that rotation in a second rotational direction of the retention member engaged therewith causes translation of the retention member in a direction away from the central bore.

15. The stripper rubber insert of claim 14 wherein the interlock feature of the stripper rubber insert extends between the shoulder and a side wall defining the central bore.

16. The stripper rubber insert of claim 14, further comprising:

a seal receiving structure within the interior insert edge face.

17. The stripper rubber insert of claim 16 wherein the seal receiving structure is positioned between the shoulder and said retention member bores.

18. The stripper rubber insert of claim 17 wherein the seal receiving structure is a seal receiving groove extending around the interior insert edge face.

19. The stripper rubber insert of claim 14 wherein the retention member securing structure of each one of said retention member bores includes threads.

* * * * *